US010827279B2

(12) United States Patent
Zhou et al.

(10) Patent No.: US 10,827,279 B2
(45) Date of Patent: Nov. 3, 2020

(54) MULTI-FUNCTION SPEAKER

(71) Applicant: AAC Technologies Pte. Ltd., Singapore (SG)

(72) Inventors: Jiasheng Zhou, Shenzhen (CN); Long Zhang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/535,072

(22) Filed: Aug. 8, 2019

(65) Prior Publication Data

US 2020/0059732 A1 Feb. 20, 2020

(30) Foreign Application Priority Data

Aug. 17, 2018 (CN) ..... 2018 2 1339872 U

(51) Int. Cl.

| | |
|---|---|
| ***H04R 9/06*** | (2006.01) |
| ***H04R 9/02*** | (2006.01) |
| ***H04R 1/02*** | (2006.01) |

(52) U.S. Cl.

CPC ..... *H04R 9/06* (2013.01); *H04R 1/02* (2013.01); *H04R 9/025* (2013.01); *H04R 2400/11* (2013.01); *H04R 2499/11* (2013.01)

(58) Field of Classification Search

None

See application file for complete search history.

(56) References Cited

U.S. PATENT DOCUMENTS

| | | | | |
|---|---|---|---|---|
| 2014/0185839 | A1* | 7/2014 | Hashimoto | H04R 9/025 381/162 |
| 2018/0302722 | A1* | 10/2018 | Linghu | H04R 7/18 |
| 2018/0302724 | A1* | 10/2018 | Li | H04R 7/12 |
| 2018/0310094 | A1* | 10/2018 | Li | H04R 7/18 |

* cited by examiner

*Primary Examiner* — Tuan D Nguyen

(74) *Attorney, Agent, or Firm* — W&G Law Group LLP

(57) ABSTRACT

A multi-function speaker includes a frame having a receiving space, a magnetic circuit system, a vibration system, and an elastic member configured to suspend the magnetic circuit system in the receiving space. The frame includes two first side portions oppositely arranged, and two oppositely disposed second side portions connecting the two first side portions. The magnetic circuit system includes a lower plate, and a magnet assembly disposed on the lower plate.

11 Claims, 6 Drawing Sheets

MULTI-FUNCTION SPEAKER

FIELD OF THE DISCLOSURE

The present disclosure relates to electro-acoustic conversions, and more particularly to a multi-function speaker applied in a portable electronic product.

DESCRIPTION OF RELATED ART

With the rapid social development, popularity of audio devices is getting higher and higher. Among masses of recreational and entertainment methods, high-quality music is gradually popularized. Therefore, speakers for playing audios are widely used in today's smart mobile devices.

A speaker in the related art includes a frame having receiving space, a vibration system, a magnetic circuit system and an elastic member. The magnetic circuit system is suspended in the receiving space of the frame by the elastic member.

The magnetic circuit system includes a yoke, a primary magnet and a secondary magnet received in the yoke. The primary magnet and the secondary magnet form a magnet assembly accommodated in the yoke, and a magnetic gap is formed between the magnetic assembly and the yoke. The vibration system includes a diaphragm and a voice coil. One end of the voice coil is suspended in the magnetic gap, and the other end of the voice coil is fixed to the diaphragm. The elastic member includes an elastic arm and a fixed arm that is connected to each other, the fixed arm is fixed to the frame and the secondary magnet.

In the related art, the structure of the speaker provides the fixed arm fixed to the secondary magnet, and a length of the fixed arm is small, that is, the fixed arm is shorter. Therefore, the structure of the speaker in the related art results a larger f0 of the multi-function speaker when the speaker operates at low frequencies, thereby limiting the performance of the multi-function speaker.

Therefore, it is desired to provide a multi-function speaker to overcome the above problem.

BRIEF DESCRIPTION OF THE DRAWINGS

Various aspects of an exemplary embodiment may be better understood with reference to the following drawings. The components in the drawing are not necessarily drawn to scale, the emphasis instead being placed upon clearly illustrating the principles of the present disclosure. Moreover, in the drawings, like reference numerals designate corresponding parts throughout the drawings.

DETAILED DESCRIPTION

The present disclosure is described in detail hereinafter with reference to an exemplary embodiment. For clearer descriptions, technical solution and beneficial effects of the present disclosure, the present disclosure is described in further detail together with the figure and the embodiments. It should be understood the specific embodiments described hereby is only to explain the disclosure, not intended to limit the disclosure.

Figure 1:
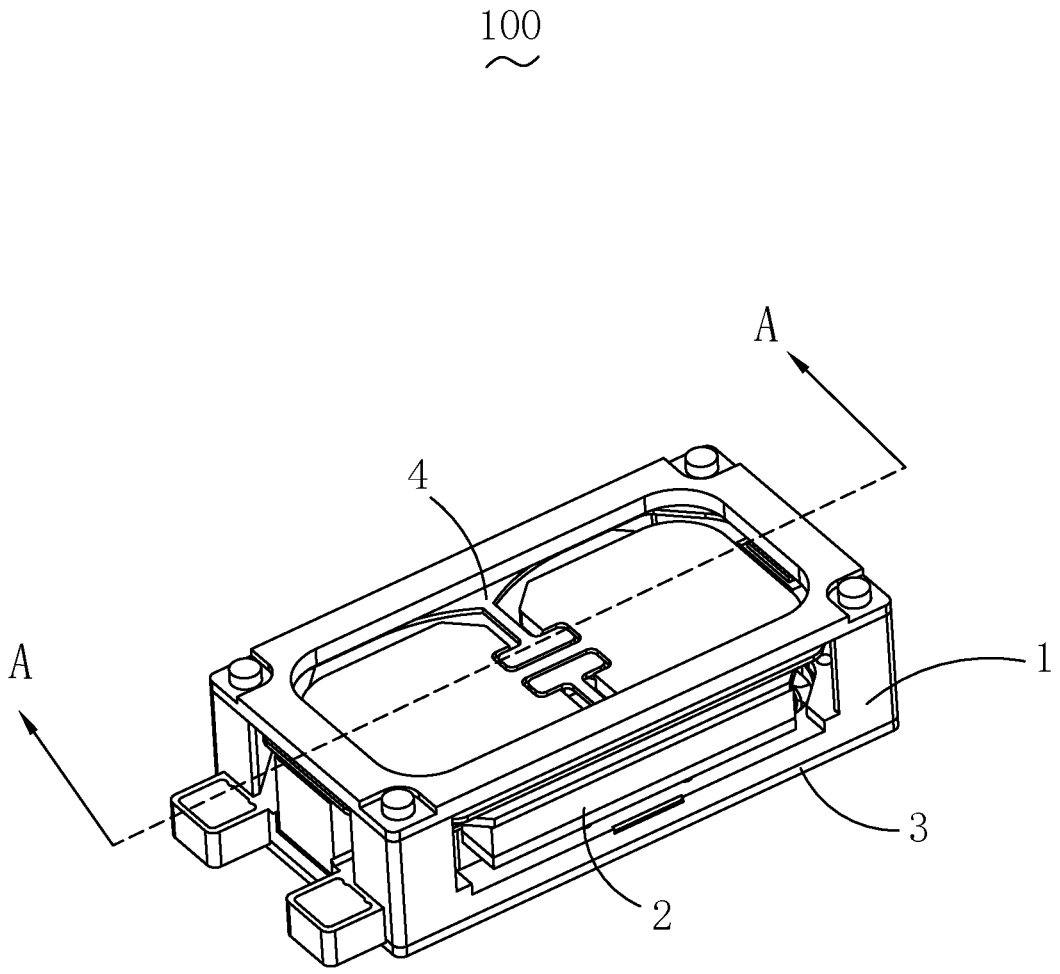
FIG. 1 is an isometric view of a multi-function speaker according to the present disclosure.
Figure 2:
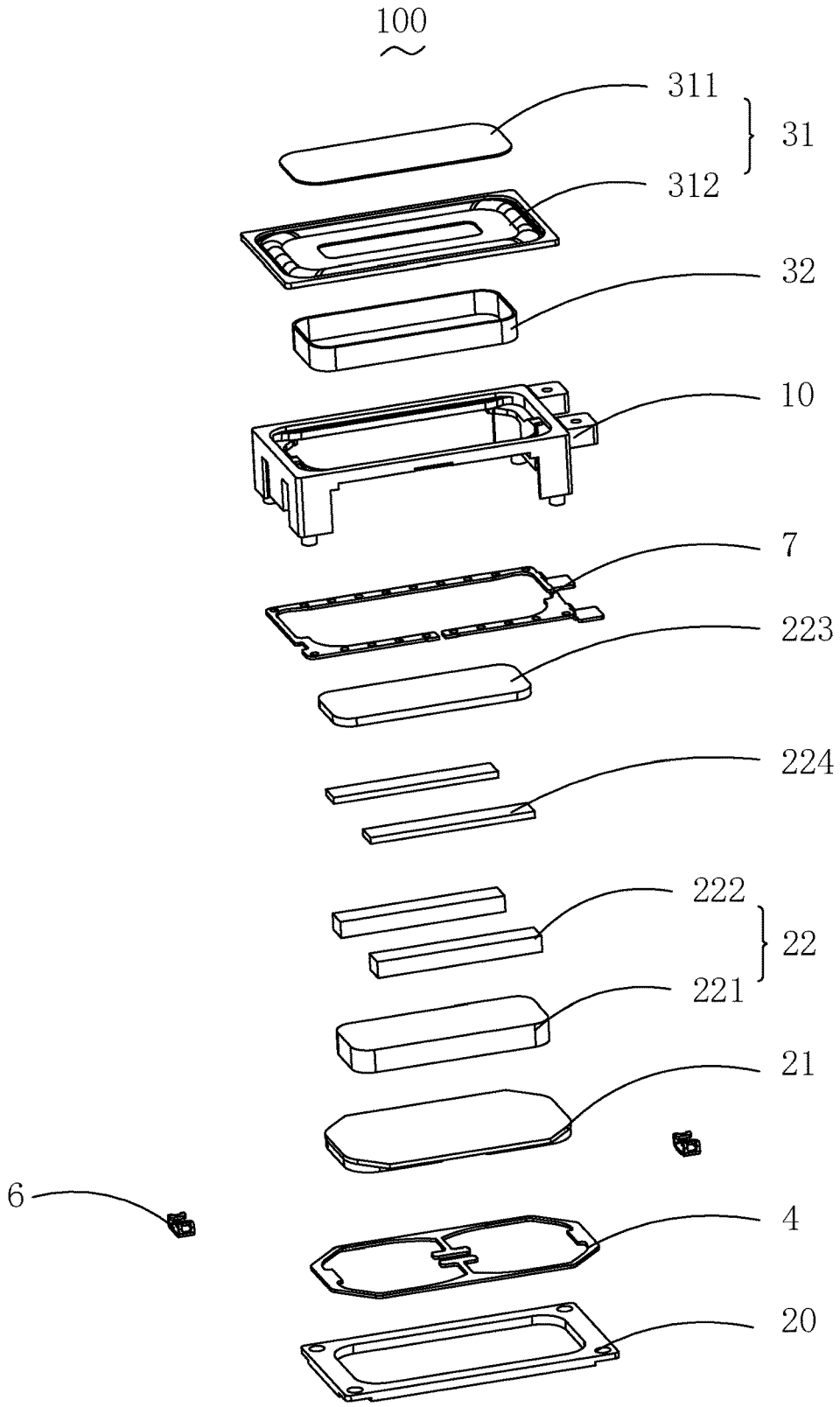
FIG. 2 is an exploded view of the multi-function speaker according to the present disclosure.
Figure 3:
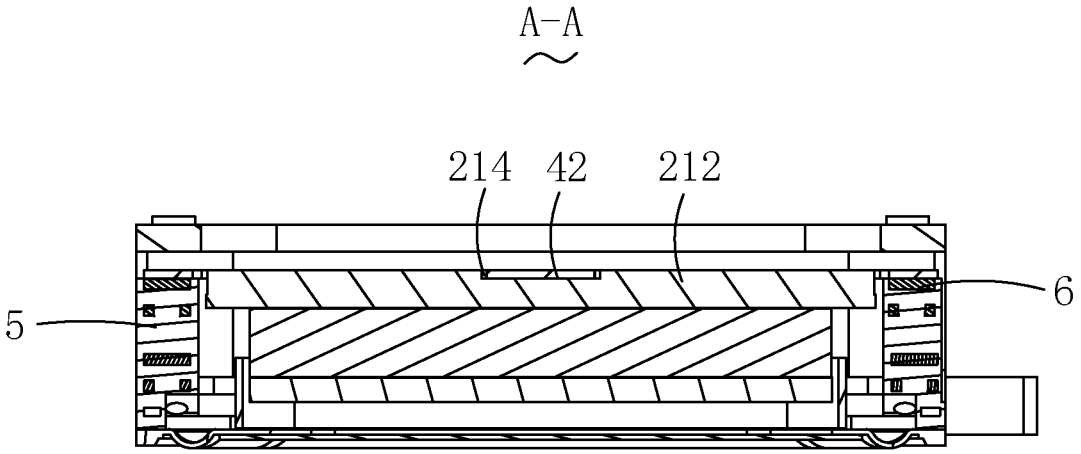
FIG. 3 is a perspective view taken along line A-A in FIG. 1.

Referring to FIG. 1 and FIG. 2, FIG. 1 is an isometric view of a multi-function speaker according to the present disclosure, and FIG. 2 is an exploded view of the multi-function speaker according to the present disclosure. The present disclosure provides a multi-function speaker 100. The multi-function speaker 100 includes a frame 1 having a receiving space, a magnetic circuit system 2, a vibration system 3 and an elastic member 4. The magnetic circuit system 2 and the vibration system 3 are received in the receiving space of the frame 1. The elastic member 4 is fixed to the frame 1 and configured to suspend the magnetic circuit system 2 in the receiving space.

The frame 1 has a rectangular shape, and the frame 1 includes an upper shell 10 that fixes the magnetic circuit system 2 and the vibration system 3 and a lower shell 20 that is fixedly engaged with the upper shell 10.

The upper shell 10 includes two first side portions 11 opposite to each other, two second side portions 12 opposite to each other and a main body 13. The two first side portions 12 are connected to the second portions 12 The main body 13 is surrounded by the first side portion 11 and the second side portion 12. The main body 13 has a rectangular shape. The main body 13 includes four support columns 131 disposed at four corners of the main body 13. The support column 131 extends along a vibration direction and distally from a direction of vibration system 3. The upper shell 10 is fixed to the lower shell 20 by the support column 131.

Figure 6:
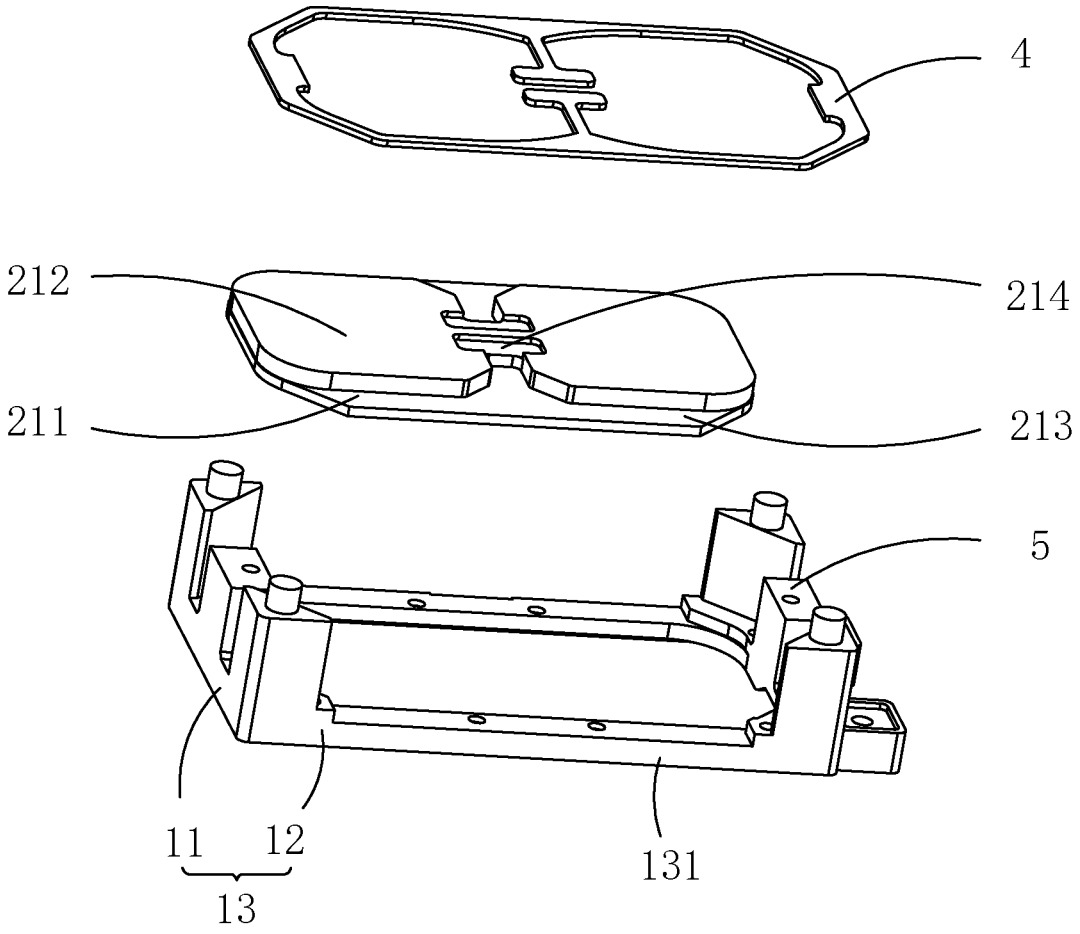
FIG. 6 is a exploded view of the multi-function according to the present disclosure.

As illustrated in FIG. 6, the magnetic circuit system 2 includes a lower plate 21, a magnet assembly 22 disposed on the lower clamping plate 21, a pole core 223 and an upper plate 224. The magnet assembly 22 includes a primary magnet 221 and both secondary magnets 222 disposed on both sides of the primary magnet 221. The lower plate 21 includes a bottom surface 211 distal from the magnet assembly 22, and a protrusion portion 212 protruding from the bottom surface 211 towards a direction distal from the magnet assembly 22. An avoidance portion is formed at position on the bottom surface 211 where the protrusion portion 212 is not disposed. The pole core 223 is disposed on the primary magnet 221, and the upper plate 224 is disposed on the secondary magnet 222.

The vibration system 3 includes a diaphragm 31 configured to vibrate to produce sound, and a voice coil 32 configured to supply a driving force for the diaphragm 31. In this embodiment, the diaphragm 31 is a two-piece diaphragm including a dome 311 at a middle position and a suspension 312 surrounding the dome 311. In another embodiment, the diaphragm 31 may also be an integral diaphragm.

Figure 4:
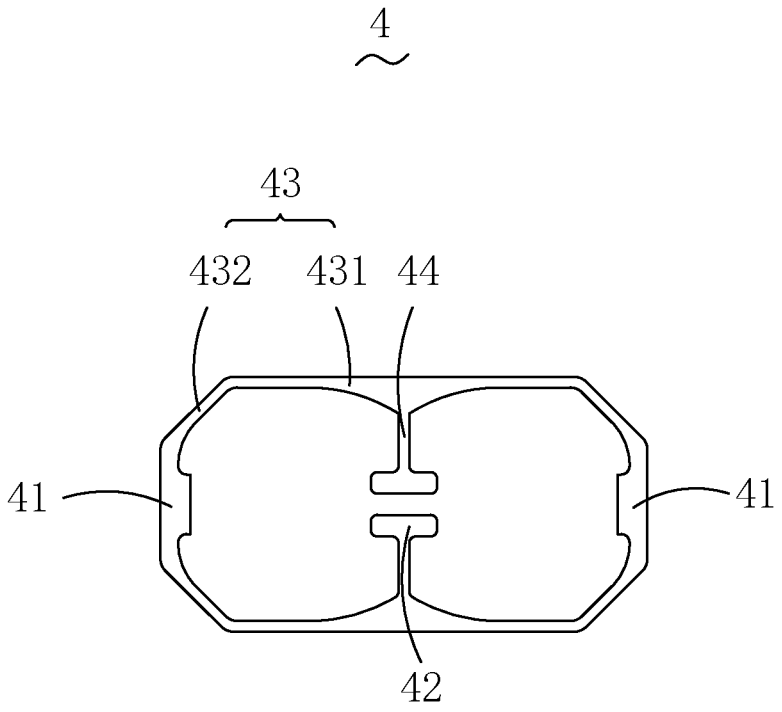
FIG. 4 is a plan view of an elastic member of the multi-function according to the present disclosure.
Figure 5:
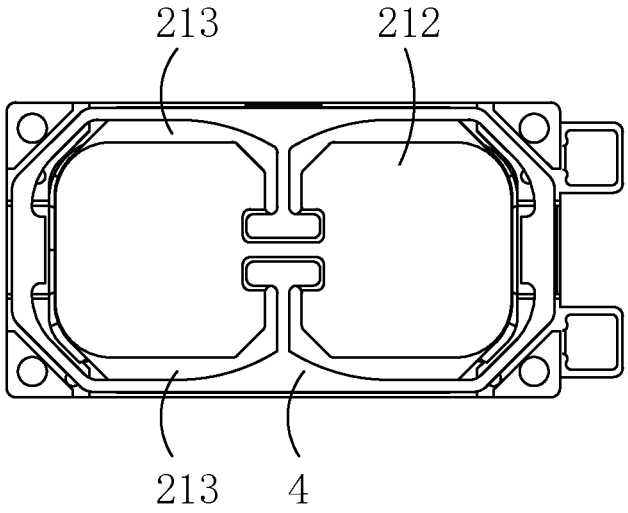
FIG. 5 is a partial structure plan view of the multi-function speaker according to the present disclosure.

As illustrated in FIG. 4 to FIG. 6, the elastic member 4 has an axisymmetric structure symmetrically arranged along an extension direction of the second side portion 12. The elastic member 4 includes two first fixed portions 41, a second fixed portion 42 fixedly connected to the protrusion portion 212, two elastic portions 43 connected to the two first fixed portions 41 and an extension portion 44. One of the two first fixed portions 41 is fixedly connected to one first side portion 11, and the other first fixed portion 41 is fixedly connected to the other first side portion 11. The elastic portion 43 is connected to the first fixed portion 41. The elastic portion 43 extends from a midpoint position of the elastic portion 43 towards a direction distal from the second side portion 12. One end of the extension portion 44 distal from the elastic portion 43 is connected to the second fixed portion 42. The elastic portion 43 includes a first elastic arm 431 disposed along the second side portion 12 and a second elastic arm 432 extending from both ends of the first elastic arm 431, the second elastic arm 432 is connected to the first fixed portion 41. The second elastic arm 432 extends obliquely from one end of the first elastic arm 431 to connect the first fixed portion 41, and an obtuse angle is formed between the first elastic arm 431 and the second elastic arm 432.

In addition, projections of the first elastic arm 431 and the extension portion 44 on the bottom surface 211 along the vibration direction fall within the avoidance portion 213, and the second elastic arm 432 and the support column 131 are spaced apart from each other. A recess portion 214 recessed from a surface of the protrusion portion 212 towards the magnet assembly 22 is disposed on the protrusion portion 21. The second fixed portion 42 is received in the recess portion 214, and the recess depth of the recess portion 214 in the vibration direction is smaller than a height of the protrusion portion 212 in the vibration direction. With the avoidance portion 213, sufficient vibration space is provided for reciprocative vibrations of the elastic member 4.

As illustrated in FIG. 4 and FIG. 5, in this embodiment, the second fixed portion 42 includes a first fixed end 421 and a second fixed end 422 spaced apart from each other, and the first fixed end 421 is connected to the extension portion 44 proximate to the first fixed end 421, and the second fixed end 422 is connected to the extension portion 44 proximate to the second fixed end 422. In another embodiment, the number of second fixed portion 42 may be only one, as long as the second fixed portion 42 fixedly connected to the extension portion 44.

In addition, the frame 1 further includes a fixed block 5 disposed on the first side portion 11. The first fixed portion 41 is fixedly connected to the fixed block 5. The multi-function speaker 100 further includes a connector 6 and a conductive terminal 7. The connection member 6 is configured to connect the first fixed portion 41 to the fixed block 5, the connection member 6 is nested in the fixed block 5. The conductive member 7 is fixed to the frame 1 and configured to be connected to an external circuit.

Compared with the related art, one aspect, the elastic member of the multi-function speaker provided by the present disclosure has a long elastic arm, and may effectively reduce f0 when the elastic member drives the low-frequency vibration of the vibration system. And in another aspect, the avoidance portion of the lower plate is disposed to receive the elastic arm for providing a sufficient vibration space for the elastic member. Such that low-frequency vibration performance of the multi-function speaker is enhanced.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A multi-function speaker, comprising:

a frame having a receiving space, the frame being in a rectangular shape, the frame comprising:
- two first side portions opposite to each other;
- two second side portions oppositely and configured to connect the two first side portions;

a vibration system received in the receiving space;

a magnetic circuit system received in the receiving space, which comprises:
- a lower plate comprising a bottom surface and a protrusion portion;
- a magnet disposed on the lower plate, wherein the bottom surface is distal from the magnet and the protrusion portion protrudes from the bottom surface towards a direction distal from the magnet;

an elastic member fixed to the frame and configured to suspend the magnetic circuit system in the receiving space, the elastic member having an axisymmetric structure symmetrically arranged along an extension direction of the second side portion, the elastic member comprising:
- two first fixed portions, wherein one of the two first fixed portions is fixedly connected to one of the first side portions, the other first fixed portion is fixedly connected to the other first side portion;
- a second fixed portion fixedly connected to the protrusion portion;
- two elastic portions, the elastic portions being connected to the first fixed portion; and
- an extension portion, the extension portions extending from a midpoint position of the elastic portion towards a direction distal from the second side portion, one end of the extension portion distal from the elastic portion is connected to the second fixed portion.

2. The multi-function speaker according to claim 1, wherein the elastic portion comprises a first elastic arm disposed along the second side portion and a second elastic arm extending from both ends of the first elastic arm, the second elastic arm being connected to the first fixed portion.

3. The multi-function speaker according to claim 2, wherein the second elastic arm extends obliquely from one end of the first elastic arm to be connected to the first fixed portion, and the first elastic arm forms an included angle with the second elastic arm, the included angle being an obtuse angle.

4. The multi-function speaker according to claim 2, wherein an avoidance portion is formed at a position on the bottom surface where the protrusion portion is not disposed, and projections of the first elastic arm and the extension portion on the bottom surface along a vibration direction fall within the avoidance portion.

5. The multi-function speaker according to claim 2, wherein the frame further comprises a main body surrounded by the first side portion and the second side portion together, the main body having a rectangular shape, the main body comprising four support columns respectively disposed at four corners of the main body, the support column extending from the main body along the vibration direction and distally from a direction of the vibration system, the support column and the second elastic arm being spaced apart from each other.

6. The multi-function speaker according to claim 1, wherein a recess portion recessed from a surface of the protrusion portion towards the magnet is disposed on the protrusion portion, and the second fixed portion is received in the recess portion.

7. The multi-function speaker according to claim 6, wherein the recess depth of the recess portion along a vibration direction is smaller than the height of the protrusion portion along the vibration direction.

8. The multi-function speaker according to claim 6, wherein the second fixed portion comprises a first fixed end and a second fixed end that are spaced apart from each other, the first fixed end being connected to the extension portion proximal to the first fixed end, the second fixed end being connected to the extension portion proximal to the second fixed end.

9. The multi-function speaker according to claim 1, wherein the frame further comprises a fixed block disposed on the first side portion, the first fixed portion being fixedly connected to the fixed block.

10. The multi-function speaker according to claim 9, wherein the multi-function speaker further comprising a connection member configured to connect the first fixed portion and the fixed block, wherein the connection member is embedded in the fixed block.

11. The multi-function speaker according to claim 10, wherein the multi-function speaker further comprising a conductive terminal, wherein the conductive terminal is fixed to the frame and configured to be connected to an external circuit.

* * * * *